US009404373B2

(12) United States Patent
Kimura et al.

(10) Patent No.: US 9,404,373 B2
(45) Date of Patent: Aug. 2, 2016

(54) TURBINE-BLADE RETAINING STRUCTURE AND ROTARY MACHINE HAVING THE SAME

(71) Applicant: MITSUBISHI HEAVY INDUSTRIES, LTD., Tokyo (JP)

(72) Inventors: Keita Kimura, Tokyo (JP); Yuki Enomoto, Tokyo (JP); Tatsuya Furukawa, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 631 days.

(21) Appl. No.: 13/751,552

(22) Filed: Jan. 28, 2013

(65) Prior Publication Data

US 2013/0224030 A1 Aug. 29, 2013

(30) Foreign Application Priority Data

Feb. 29, 2012 (JP) ..... 2012-044672

(51) Int. Cl.
*F01D 5/32* (2006.01)
*F01D 5/30* (2006.01)

(52) U.S. Cl.
CPC ..... *F01D 5/32* (2013.01); *F01D 5/3015* (2013.01); *F01D 5/323* (2013.01); *F01D 5/326* (2013.01); *F05D 2230/232* (2013.01)

(58) Field of Classification Search
CPC ..... F01D 5/32; F01D 5/323; F01D 5/326; F01D 5/3015; F01D 5/3007; F01D 5/3061; F05D 2230/232; F04D 29/34
See application file for complete search history.

(56) References Cited

U.S. PATENT DOCUMENTS

| | | | | |
|---|---|---|---|---|
| 5,662,458 | A * | 9/1997 | Owen | F01D 11/006 416/145 |
| 7,244,105 | B2 * | 7/2007 | Moeller | F01D 5/3015 416/220 R |
| 8,105,041 | B2 * | 1/2012 | Brillert et al. | 416/221 |
| 8,128,371 | B2 * | 3/2012 | Ravi et al. | 416/212 R |
| 8,192,167 | B2 * | 6/2012 | Helmis et al. | 416/220 R |
| 2003/0194318 | A1 | 10/2003 | Duesler et al. | |

(Continued)

FOREIGN PATENT DOCUMENTS

| | | |
|---|---|---|
| CN | 1752416 | 3/2006 |
| CN | 101506475 | 8/2009 |
| DE | 1212108 | 3/1966 |

(Continued)

OTHER PUBLICATIONS

Office Action issued Apr. 1, 2015 in corresponding Chinese patent application No. 201380010904.6 (with English translation).

(Continued)

*Primary Examiner* — Richard Edgar
*Assistant Examiner* — Brian P Wolcott
(74) *Attorney, Agent, or Firm* — Wenderoth, Lind & Ponack, L.L.P.

(57) ABSTRACT

A turbine-blade retaining structure in which deformation of end portions of locking pieces exposed through an insertion window portion in the axial direction is prevented, and the occurrence of a crack in a welded portion is prevented. At least one of the end portions of adjacent locking pieces exposed through the insertion window portion is provided with a thick-plate portion that expands in the disc-thickness direction so as to be inside the insertion window portion.

12 Claims, 6 Drawing Sheets

(56) References Cited

U.S. PATENT DOCUMENTS

| | | | |
|---|---|---|---|
| 2005/0084376 | A1 | 4/2005 | Hopp |
| 2009/0116965 | A1 | 5/2009 | Brillert et al. |

FOREIGN PATENT DOCUMENTS

| | | |
|---|---|---|
| DE | 10 2010 015 404 | 10/2011 |
| JP | 59-75502 | 5/1984 |
| JP | 6-137104 | 5/1994 |
| JP | 2009-507176 | 2/2009 |

OTHER PUBLICATIONS

Decision to Grant a Patent issued Apr. 17, 2015 in corresponding Korean patent application No. 2014-7022749.

Decision to Grant a Patent issued Dec. 2, 2014 in corresponding Japanese patent application No. 2012-044672.

International Search Report (with partial English translation) issued in International Application No. PCT/JP2013/051041 on Apr. 16, 2013.

Written Opinion of the International Searching Authority (in English language) issued in International Application No. PCT/JP2013/051041 on Apr. 16, 2013.

Decision to Grant a Patent issued Sep. 15, 2015 in corresponding Chinese Patent Application No. 201380010904.6 (with English translation).

Office Action issued May 22, 2015 in corresponding German patent application No. 112013001205.7 (with English translation).

* cited by examiner

TURBINE-BLADE RETAINING STRUCTURE AND ROTARY MACHINE HAVING THE SAME

CROSS-REFERENCE TO RELATED APPLICATIONS

This application is based on Japanese Patent Application No. 2012-044672, the contents of which are incorporated herein by reference.

BACKGROUND OF THE INVENTION

1. Technical Field

The present invention relates to a turbine-blade retaining structure that retains turbine blades to a rotor disc.

2. Description of the Related Art

Known turbine-blade retaining structures that secure the turbine blades of a rotary machine to a rotor disc include, for example, that disclosed in PCT International Application, Publication No. 2009-507176.

SUMMARY OF THE INVENTION

1. Technical Problem

In addition, a turbine-blade retaining structure 51 in a steam turbine, such as that shown in FIGS. 5 to 10, has been proposed in recent years.

As shown in at least one of FIGS. 5 to 10, the turbine-blade retaining structure 51 secures turbine blades 52 to a rotor disc 53 and prevents the turbine blades 52 from coming out (restrains movement of the turbine blades 52).

The turbine blades 52 are each provided with a Christmas-tree-shaped blade root (bottom) 62 that is slotted into a blade groove 61 formed on the circumferential edge portion of the rotor disc 53 to hold (support) the whole body of the turbine blade 52, a blade portion 63, a platform 64 that supports the blade portion 63, and a shroud (not shown) that extends along the circumferential direction from the distal end (tip) of the blade portion 63 to prevent resonance of the turbine blade 52 and to reduce the leakage loss (leakage of steam) at the distal end of the blade portion 63.

The rotor disc 53 is provided with the blade grooves 61 that extend through the rotor disc 53 in the disc-thickness direction (axial direction) so as to receive the blade roots 62 of the turbine blades 52 that are arranged in the circumferential direction (the blade roots 62 are fitted thereto), a protruding portion (thick-plate portion) 65 that protrudes outwards in the disc-thickness direction as a whole such that its outer circumferential end is located at the inner side of the inner circumferential end of the blade groove 61 in the radial direction, and a ring-shaped locking groove 67 that is formed in the circumferential edge portion of the protruding portion 65 along the circumferential direction so as to open towards the outer side in the radial direction such that locking pieces (clamp members) 66, which are arranged in the circumferential direction, are received therein (the locking pieces 66 are fitted thereto).

On the circumferential edge portion of the protruding portion 65, at least one insertion window portion (cut-out portion) 68, which is cut out in the disc-thickness direction such that its inner circumferential surface is flush with the inner circumferential surface of the locking groove 67, is provided along the circumferential direction (in the turbine-blade retaining structure 51 shown in FIGS. 5 to 10, a total of two insertion window portions 68 are located at positions separated by 180 degrees in the circumferential direction (one at each position)).

The locking pieces 66 are plate-like members that are fitted (arranged) between the locking groove 67 and a step portion 69 that protrudes outwards in the disc-thickness direction in the circumferential edge portion on the inner circumferential side of the blade root 62 so as to face the locking groove 67. The circumferential end surface located on the inner circumferential side of the locking piece 66 is curved so as to have the same radius of curvature as (so as to be in contact with) the bottom surface forming the locking groove 67, and the circumferential end surface located on the outer circumferential side of the locking piece 66 is curved so as to have the same radius of curvature as (so as to be in contact with) the circumferential end surface that is located on the inner circumferential side and that forms the step portion 69.

In addition, among the locking pieces 66 arranged so as to be fitted between the locking groove 67 and the step portion 69, the adjacent locking pieces 66 that are exposed (visible) through the insertion window portion 68 are joined to each other at the end portions thereof by means of spot-welding.

Reference numeral 70 in FIGS. 5, 6, 8, 10, and 11 indicates a portion welded by means of spot-welding.

With such a turbine-blade retaining structure 51, as shown in FIG. 11, a load (force) caused by the turbine blades 52, which have a tendency to come out from the rotor disc in the axial direction, acts on the end portions of the two locking pieces 66 exposed through the insertion window portion 68. Thus, there has been a problem in that the end portions of the locking pieces 66 are deformed in the axial direction, causing a crack 71 in the welded portion 70.

In addition, with such a turbine-blade retaining structure 51, as shown in FIG. 10(*b*), steam drain 72 collides with the welded portion 70, causing erosion of the welded portion 70. Thus, there has also been a problem in that the welded portion 70 is weakened, and the crack 71 tends to be caused in the welded portion 70.

The present invention has been conceived in light of the above-described circumstances, and an object thereof is to provide a turbine-blade retaining structure and a rotary machine having the turbine-blade retaining structure that are capable of preventing deformation of end portions of locking pieces exposed through an insertion window portion provided on a protruding portion of a rotor disc in the axial direction of the rotor disc and that are capable of preventing the occurrence of a crack in a welded portion where the end portions of the locking pieces are welded to each other.

2. Solution to the Problem

In order to solve the problems described above, the present invention employs the following solutions.

A turbine-blade retaining structure according to a first aspect of the present invention includes: blade grooves that extend through a rotor disc in a disc-thickness direction so as to receive blade roots of turbine blades arranged in a circumferential direction; a protruding portion that protrudes, as a whole, outwards in the disc-thickness direction such that its outer circumferential end is located at an inner side of an inner circumferential end of the blade grooves in the radial direction; a ring-shaped locking groove that is formed in a circumferential edge portion of the protruding portion along the circumferential direction so as to open towards an outer side in the radial direction to receive a plate-like locking piece, which is arranged in the circumferential direction; a step portion that protrudes outwards in the disc-thickness direction in a circumferential edge portion on an inner circumferential side of the blade root so as to face the locking groove; and the locking piece that is fitted between the locking groove and the step portion; wherein the circumferential edge portion of the protruding portion is provided with, along the circumferential direction, at least one insertion window portion that is cut out in the disc-thickness direction such that an inner circumferential surface thereof is flush with an inner circumferential surface of the locking groove, and end portions of the adjacent locking pieces exposed through the insertion window portion are joined to each other by means of welding; and at least one of the end portions of the adjacent locking pieces exposed through the insertion window portion is provided with a thick-plate portion expanding in the disc-thickness direction so as to be inside the insertion window portion.

With the turbine-blade retaining structure according to the above-mentioned aspect, the end portion of the locking piece exposed through the insertion window portion is formed to have a plate thickness greater than that of the locking piece forming the portion other than the thick-plate portion; in other words, the end portion of the locking piece exposed through the insertion window portion is formed such that the rigidity thereof is higher (greater) than that in a conventional structure.

By doing so, it is possible to prevent (reduce) deformation of the end portions of the locking pieces exposed through the insertion window portion in the axial direction and to prevent the occurrence of a crack in the welded portion.

In the above-mentioned turbine-blade retaining structure, preferably, the thick-plate portion is provided from one end of the locking piece that is joined by means of welding towards a side at the other end.

According to such a turbine-blade retaining structure, the thick-plate portion is provided from the one end of the locking piece that is joined by means of welding towards the side at the other end. In other words, the thick-plate portion is provided in wider region in the longitudinal direction than the thick-plate portion in the above-mentioned turbine-blade retaining structure.

By doing so, it is possible to prevent (reduce), to an even greater extent, deformation of the end portions of the locking pieces exposed through the insertion window portion in the axial direction, and it is possible to prevent, to an even greater extent, the occurrence of a crack in the welded portion.

In the above-mentioned turbine-blade retaining structure, preferably, a recessed groove is provided in a central portion of the thick-plate portion in the width direction so as to extend from the one end of the locking piece, which is joined by means of welding, towards the side at the other end and so as to open at the one end.

According to such a turbine-blade retaining structure, at least a part of the welded portion that joins the end portions of the adjacent locking pieces exposed through the insertion window portion to each other is located (accommodated) in the recessed groove.

By doing so, it is possible to reduce the problem where a crack tends to be caused in the welded portion that has been eroded and weakened due to collision and adhesion of steam drain on the welded portion.

In the above-mentioned turbine-blade retaining structure, preferably, the thick-plate portion is provided in the end portion of the locking piece on a leading side in a rotation direction of the rotor disc.

According to such a turbine-blade retaining structure, the welded portion that joins the end portions of the adjacent locking pieces exposed through the insertion window portion to each other is formed on the opposite side of the thick-plate portion from the leading side in the rotation direction of the rotor disc. In other words, the welded portion that joins the end portions of the adjacent locking pieces exposed through the insertion window portion to each other is provided behind the thick-plate portion.

By doing so, it is possible to further reduce the problem where a crack tends to be caused in the welded portion that has been eroded and weakened due to collision of the steam drain on the welded portion.

In the above-mentioned turbine-blade retaining structure, preferably, a sloped portion is provided so as to be formed to have a plate thickness that increases gradually from one end of the locking piece, which is joined by means of welding, towards a side at the other end.

According to such a turbine-blade retaining structure, the last locking piece to be inserted into the insertion window portion is inserted along the sloped portion.

By doing so, it is possible to insert the last locking piece to be inserted into the insertion window portion with ease and to improve the ease of assembly.

A rotary machine according to a second aspect of the present invention includes any one of the above-mentioned turbine-blade retaining structures.

The rotary machine according to the above-mentioned aspect is provided with the turbine-blade retaining structure that is capable of preventing deformation of the end portions of the locking pieces exposed through the insertion window portion in the axial direction and capable of preventing the occurrence of a crack in the welded portions.

By doing so, it is possible to prevent fragments of the locking pieces and the welded portion from scattering downstream, thereby improving the reliability of the rotary machine.

3. Advantageous Effects of the Invention

According to the present invention, advantages are afforded in that it is possible to prevent deformation, in the axial direction, of end portions of locking pieces exposed through an insertion window portion and to prevent the occurrence of a crack in a welded portion.

DETAILED DESCRIPTION OF THE INVENTION

First Embodiment

A turbine-blade retaining structure of a first embodiment of the present invention, which is utilized for a steam turbine, will be described below with reference to FIG. 1.

Figure 1:
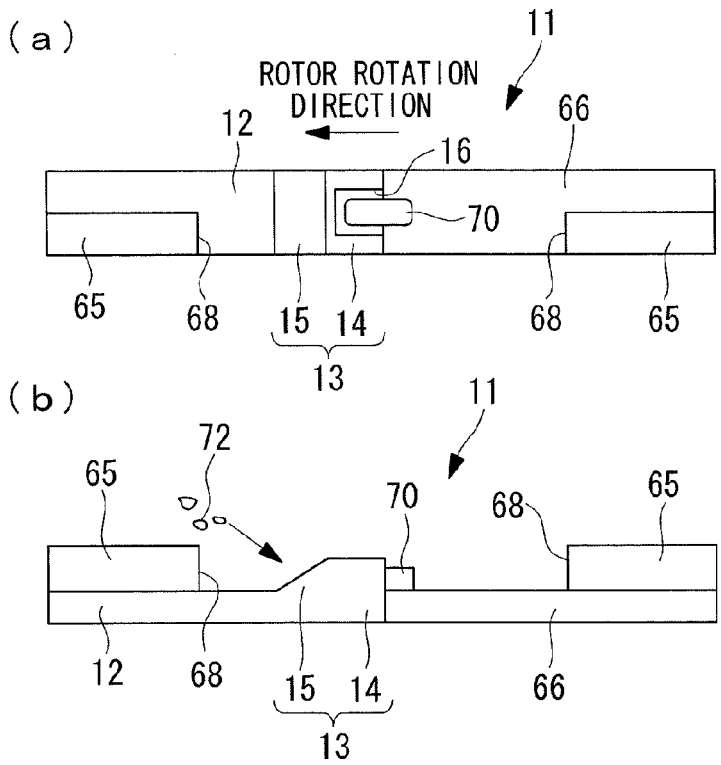
FIG. 1 is a view showing relevant parts of a turbine-blade retaining structure according to a first embodiment of the present invention, where (a) is a front view, and (b) is a bottom view of (a) viewed from below.

FIG. 1 is a view showing relevant parts of the turbine-blade retaining structure according to this embodiment, in which (a) is a front view, and (b) is a bottom view of (a) viewed from below.

Figure 5:
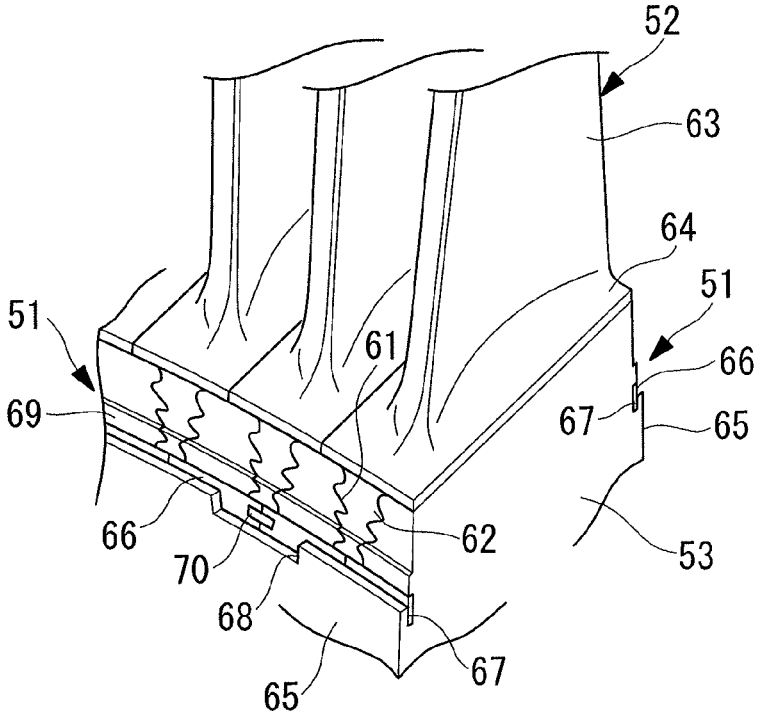
FIG. 5 is a perspective view showing relevant parts of a turbine-blade retaining structure, which has been proposed in recent years.
Figure 6:
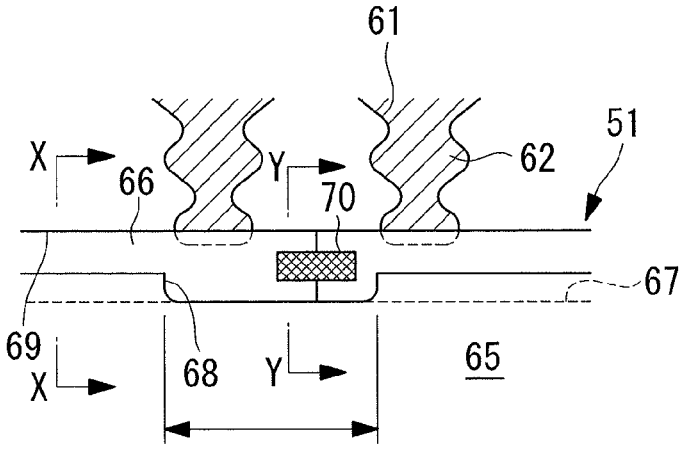
FIG. 6 is a front view showing, in enlarged form, relevant parts of FIG. 5.
Figure 7:
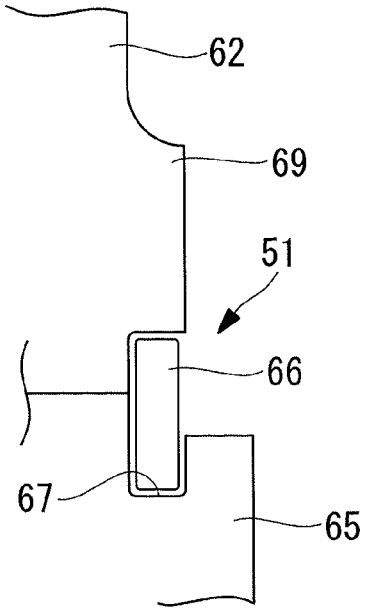
FIG. 7 is a sectional view taken along line X-X in FIG. 6.
Figure 8:
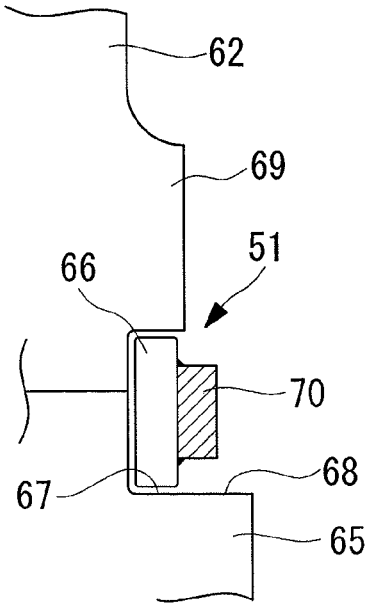
FIG. 8 is a sectional view taken along line Y-Y in FIG. 6.
Figure 9:
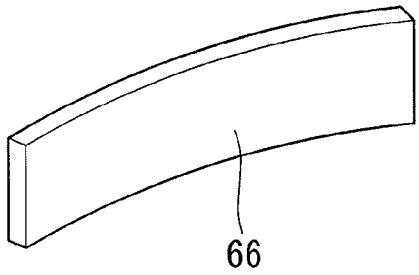
FIG. 9 is a perspective view of the locking pieces shown in FIGS. 5 to 8.
Figure 10:
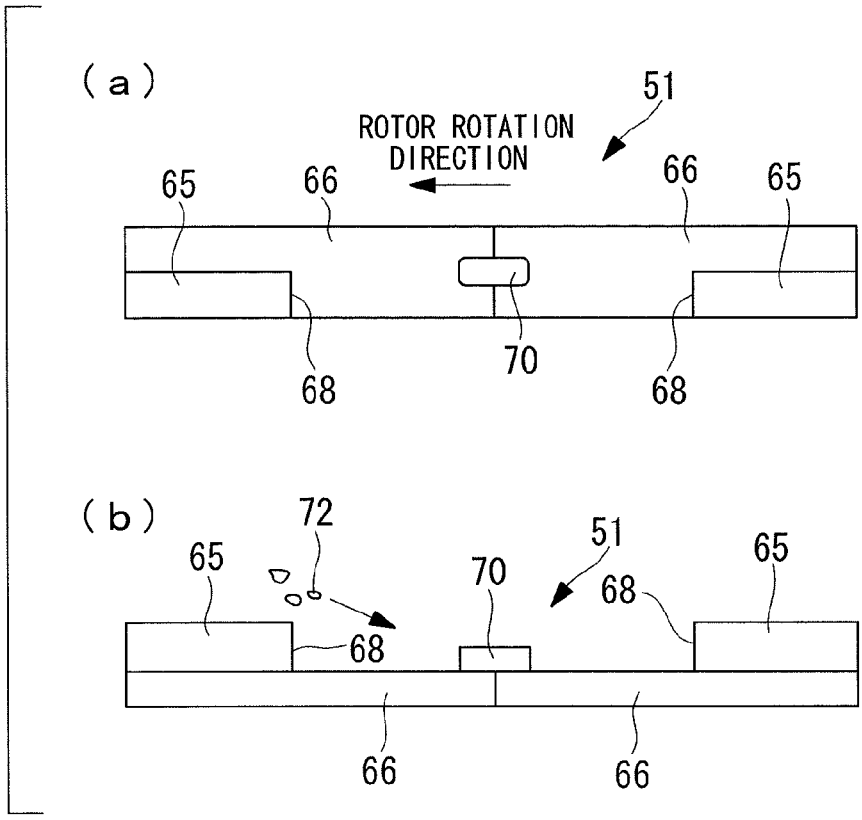
FIG. 10 is a front view showing, in enlarged form, relevant parts of FIG. 5.
Figure 11:
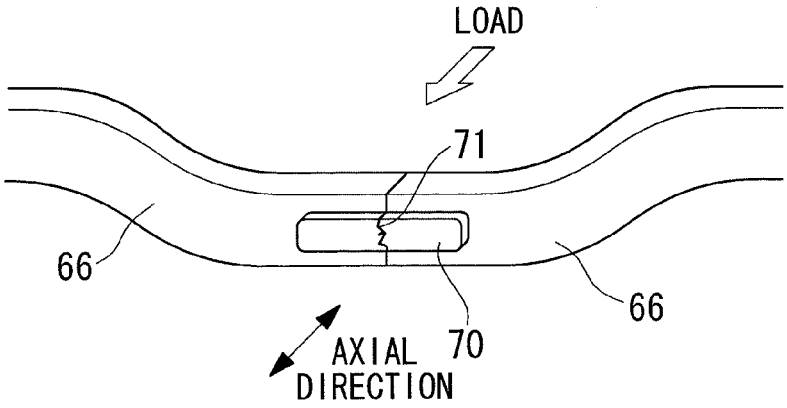
FIG. 11 is a view for explaining problems in the turbine-blade retaining structure proposed in recent years.

A turbine-blade retaining structure 11 according to this embodiment secures the turbine blades 52 (see FIG. 5) to the rotor disc 53 (see FIG. 5) and prevents the turbine blades 52 from coming out (restrains movement of the turbine blades 52).

Because the turbine blades 52 and the rotor disc 53 have been explained in the above-described "Technical Problem", explanations thereof will be omitted herein.

As shown in FIG. 1, in the turbine-blade retaining structure 11 according to this embodiment, among two adjacent locking pieces exposed (visible) through the insertion window portion 68, one of the locking pieces has the configuration shown on the left-hand side in FIG. 1, and the other locking piece has the configuration shown on the right-hand side in FIG. 1 (the locking piece 66 explained in the above-described "Technical Problem").

Because the locking piece 66 has been explained in the above-described "Technical Problem", an explanation thereof will be omitted herein.

One locking piece 12 is, as with the other locking piece 66, a plate-like member that is fitted (arranged) between the locking groove 67 (see FIGS. 5 to 8) and the step portion 69 (see FIGS. 5 to 8) that protrudes outwards in the disc-thickness direction in the circumferential edge portion on the inner circumferential side of the blade root 62 (see FIGS. 5 to 8) so as to face the locking groove 67. The circumferential end surface located on the inner circumferential side of the locking piece 12 is curved so as to have the same radius of curvature as (so as to be in contact with) the bottom surface forming the locking groove 67, and the circumferential end surface located on the outer circumferential side of the locking piece 12 is curved so as to have the same radius of curvature as (so as to be in contact with) the circumferential end surface that is located on the inner circumferential side and that forms the step portion 69.

The end portion of the locking piece 12, which is exposed through the insertion window portion 68 and which is joined to the end portion of the locking piece 66 exposed through the insertion window portion 68 by means of spot-welding, is provided with a thick-plate portion 13 expanding (protruding) in the disc-thickness direction (a direction perpendicular to the plane of the drawing in FIG. 1(*a*): the up-down direction in FIG. 1(*b*)) over the entire width direction (the up-down direction in FIG. 1(*a*): a direction perpendicular to the plane of the drawing in FIG. 1(*b*)) so as to be inside the insertion window portion 68 (so as to be directed outwards in the axial direction).

The thick-plate portion 13 is a portion that is formed to have a plate thickness greater than that of the locking piece 12 forming the portion other than the thick-plate portion 13, and is provided with a plate-like portion (constant plate thickness portion) 14 and a sloped portion (varying plate thickness portion) 15.

The plate-like portion 14 is a plate-like portion having a constant plate thickness (thickness) over the entire width direction and longitudinal direction (the left-right direction in FIGS. 1(*a*) and 1(*b*)).

The sloped portion 15 continuously connects one end (base end) of the plate-like portion 14 in the longitudinal direction and one end of the locking piece 12 forming the portion other than the thick-plate portion 13, and the sloped portion 15 is a portion that is formed to have a plate thickness that decreases gradually (at a certain rate) from one end of the plate-like portion 14 in the longitudinal direction to (towards) one end of the locking piece 12 forming the portion other than the thick-plate portion 13. In other words, the sloped portion 15 continuously connects one end (base end) of the plate-like portion 14 in the longitudinal direction and one end of the locking piece 12 forming the portion other than the thick-plate portion 13, and the sloped portion 15 is a portion that is formed to have a plate thickness that decreases gradually (at a certain rate) in (towards) the rotation direction of the rotor disc 53 (direction in which the rotor disc 53 rotates).

In addition, in the central portion of the plate-like portion 14 in the width direction, a recessed groove (recessed portion) 16 having a (substantially) rectangular shape in front view is provided so as to extend from the vicinity of one end to the other end of the plate-like portion 14 in the longitudinal direction and so as to open at the other end of the plate-like portion 14 in the longitudinal direction. The bottom surface of the recessed groove 16 is formed to have a surface flush with the front surface of the locking piece 66 (in other words, the front surface of the locking piece 12 forming the portion other than the thick-plate portion 13). In other words, the plate thickness of the recessed groove 16 is the same as the plate thickness of the locking piece 66 and the same as the plate thickness of the locking piece 12 forming the portion other than the thick-plate portion 13.

With the turbine-blade retaining structure 11 according to this embodiment, the end portion of the locking piece 12 exposed through the insertion window portion 68 is formed to have a plate thickness greater than that of the locking piece 12 forming the portion other than the thick-plate portion 13; in other words, the end portion of the locking piece 12 exposed through the insertion window portion 68 is formed such that the rigidity thereof is higher (greater) than that in a conventional structure.

By doing so, it is possible to prevent (reduce) deformation of the end portions of the locking pieces 12 exposed through the insertion window portion 68 in the axial direction of the rotor disc and to prevent the occurrence of a crack in the welded portion 70.

In addition, with the turbine-blade retaining structure 11 according to this embodiment, a part of the welded portion 70 that joins the end portions of the adjacent locking pieces 12 and 66 exposed through the insertion window portion 68 to each other is located (accommodated) in the recessed groove 16.

By doing so, it is possible to reduce the problem where a crack tends to be caused in the welded portion 70 that has been eroded and weakened due to collision of the steam drain 72 on the welded portion 70.

Furthermore, with the turbine-blade retaining structure 11 according to this embodiment, the welded portion 70 that joins the end portions of the adjacent locking pieces 12 and 66 exposed through the insertion window portion 68 to each other is formed on the opposite side of the thick-plate portion 13 from the leading side in the rotation direction of the rotor disc 53. In other words, the welded portion 70 that joins the end portions of the adjacent locking pieces 12 and 66 exposed through the insertion window portion 68 to each other is provided behind the thick-plate portion 13.

By doing so, it is possible to further reduce the problem where a crack tends to be caused in the welded portion 70 that has been eroded and weakened due to collision of the steam drain 72 on the welded portion 70.

On the other hand, with the steam turbine provided with the turbine-blade retaining structure 11 according to this embodiment, it is possible to prevent fragments of the locking pieces 12 and 66 and the welded portion 70 from scattering downstream, thereby improving the reliability of the steam turbine.

Second Embodiment

The turbine-blade retaining structure of a second embodiment of the present invention, which is utilized for a steam turbine, will be described below with reference to FIGS. 2 to 4.

Figure 2:
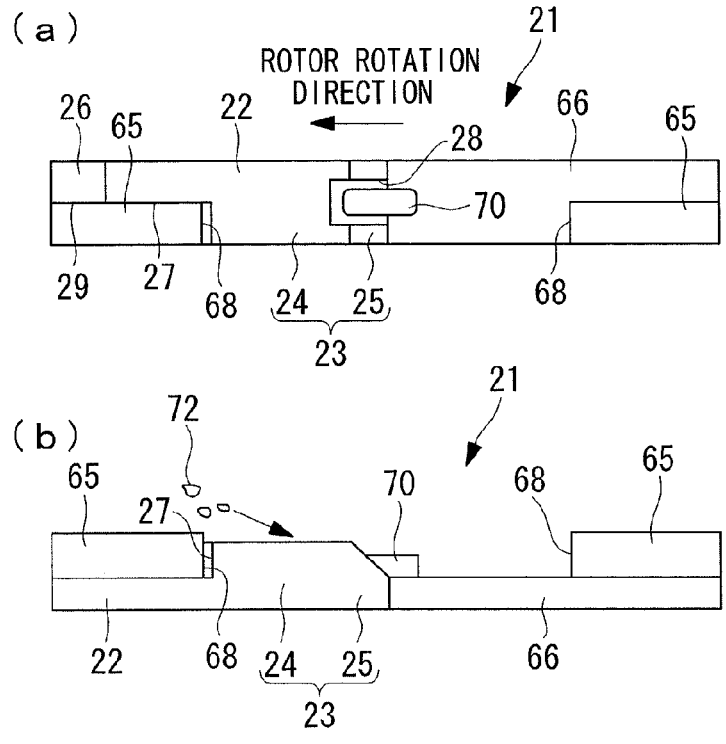
FIG. 2 is a view showing relevant parts of a turbine-blade retaining structure according to a second embodiment of the present invention, where (a) is a front view, and (b) is a bottom view of (a) viewed from below.

FIG. 2 is a view showing relevant parts of the turbine-blade retaining structure according to this embodiment, in which (a) is a front view, and (b) is a bottom view of (a) viewed from below; FIG. 3 is a perspective view showing relevant parts of the turbine-blade retaining structure according to this embodiment; and FIG. 4 is a perspective view showing, in disassembled form, the locking pieces exposed through the insertion window portion.

A turbine-blade retaining structure 21 according to this embodiment differs from that in the first embodiment described above in that locking pieces 22 are provided instead of the locking pieces 12. The other constituent elements are the same as those in the first embodiment described above, and therefore, a description of those constituent elements is omitted here.

Parts that are identical to those in the first embodiment described above are assigned the same reference numerals.

Figure 3:
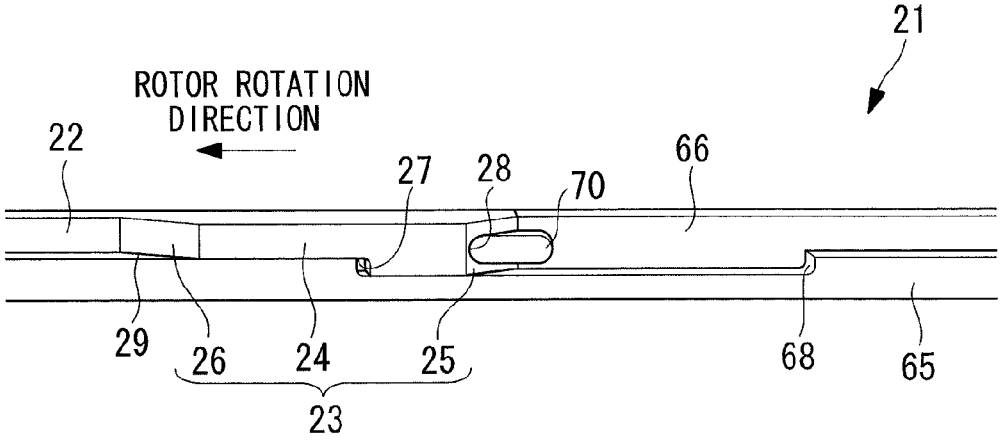
FIG. 3 is a perspective view showing relevant parts of the turbine-blade retaining structure according to the second embodiment of the present invention.
Figure 4:
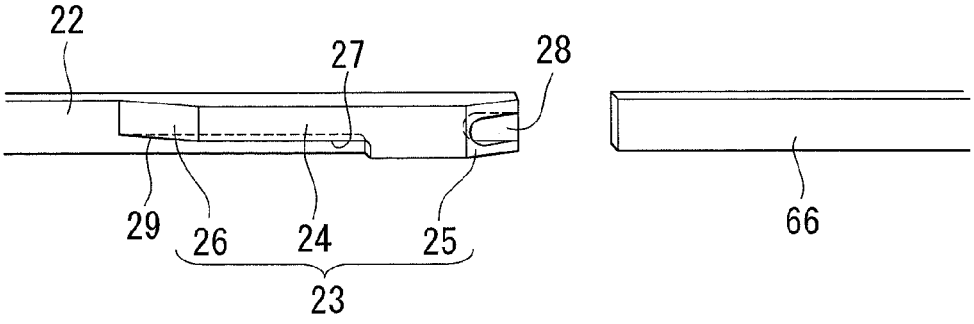
FIG. 4 is a perspective view showing, in disassembled form, locking pieces exposed through an insertion window portion.

As shown in at least one of FIGS. 2 to 4, in the turbine-blade retaining structure 21 according to this embodiment, among the two adjacent locking pieces exposed (visible) through the insertion window portion 68, one of the locking pieces has the configuration shown on the left-hand side in FIGS. 2 to 4, and the other locking piece has the configuration shown on the right-hand side in FIGS. 2 to 4 (the locking piece 66 explained in above-described "Technical Problem").

Because the locking piece 66 has been explained in the above-described "Technical Problem", an explanation thereof will be omitted herein.

One locking piece 22 is, as with the other locking piece 66, a plate-like member that is fitted (arranged) between the locking groove 67 (see FIGS. 5 to 8) and the step portion 69 (see FIGS. 5 to 8) that protrudes outwards in the disc-thickness direction in the circumferential edge portion on the inner circumferential side of the blade root 62 (see FIGS. 5 to 8) so as to face the locking groove 67. The circumferential end surface located on the inner circumferential side of the locking piece 22 is curved so as to have the same radius of curvature as (so as to be in contact with) the bottom surface forming the locking groove 67, and the circumferential end surface located on the outer circumferential side of the locking piece 22 is curved so as to have the same radius of curvature as (so as to be in contact with) the circumferential end surface that is located on the inner circumferential side and that forms the step portion 69.

The end portion of the locking piece 22, which is exposed through the insertion window portion 68 and which is joined to the end portion of the locking piece 66 exposed through the insertion window portion 68 by means of spot-welding, is provided with a thick-plate portion 23 expanding (protruding) in the disc-thickness direction (a direction perpendicular to the plane of the drawing in FIG. 2(*a*): the up-down direction in FIG. 2(*b*)) over the entire longitudinal direction (the left-right direction in FIGS. 2 to 4) so as to be directed outwards in the axial direction.

The thick-plate portion 23 is a portion that is formed to have a plate thickness greater than that of the locking piece 22 forming the portion other than the thick-plate portion 23, and is provided with a plate-like portion (constant plate thickness portion) 24, a (first) sloped portion (varying plate thickness portion) 25, and a (second) sloped portion (varying plate thickness portion) 26.

The plate-like portion 24 is a plate-like portion having a constant plate thickness (thickness) over the entire longitudinal direction and is formed so as also to have, in a region from the vicinity of the center to one end (distal end) in the longitudinal direction, a constant plate thickness (thickness) over the entire width direction (the up-down direction in FIG. 2(*a*): the direction perpendicular to the plane of the drawing in FIG. 2(*b*)).

In addition, in the region from the vicinity of the center to the other end (base end) of the plate-like portion 24 in the longitudinal direction, a cut-out portion 27 is provided. The cut-out portion 27 is defined by the inner circumferential surface facing (in contact with) the outer circumferential surface of the protruding portion 65, the side surface that extends along the radial direction and that is located at one side on the inner circumferential surface of the insertion window portion 68 so as to face one of the end surfaces that forms the insertion window portion 68 together with the inner circumferential surface of the insertion window portion 68, and the bottom surface that is located at the outer side in the axial direction so as to face (be in contact with) the wall surface forming the locking groove 67.

The plate thickness of the cut-out portion 27 is the same as the plate thickness of the locking piece 66 and the plate thickness of the locking piece 22 forming the portion other than the thick-plate portion 23.

The sloped portion 25 continuously connects one end of the plate-like portion 24 in the longitudinal direction and one end (distal end) of the locking piece 22, and the sloped portion 25 is a portion that is formed to have a plate thickness that decreases gradually (at a certain rate) from one end of the plate-like portion 24 in the longitudinal direction to (towards) one end of the locking piece 22. In other words, the sloped portion 25 continuously connects one end (distal end) of the plate-like portion 24 in the longitudinal direction and one end of the locking piece 22, and the sloped portion 25 is a portion that is formed to have a plate thickness that decreases gradually (at a certain rate) in (towards) the direction opposite to the rotation direction of the rotor disc 53 (see FIG. 5) (direction in which the rotor disc 53 rotates).

In addition, in the central portion of the sloped portion 25 in the width direction, a recessed groove (recessed portion) 28 having a (substantially) rectangular shape in front view is provided so as to extend from the vicinity of one end (base end) to the other end (distal end) of the sloped portion 25 in the longitudinal direction and so as to open at the other end of the sloped portion 25 in the longitudinal direction. The bottom surface of the recessed groove 28 is formed to have a surface flush with the front surface of the locking piece 66 (in other words, the front surface of the locking piece 22 forming the portion other than the thick-plate portion 23). In other words, the plate thickness of the recessed groove 28 is the same as the plate thickness of the locking piece 66 and the same as the plate thickness of the locking piece 22 forming the portion other than the thick-plate portion 23.

The sloped portion 26 continuously connects the other end (base end) of the plate-like portion 24 in the longitudinal direction and one end (distal end) of the locking piece 22 forming the portion other than the thick-plate portion 23, and the sloped portion 26 is a portion that is formed to have a plate thickness that decreases gradually (at a certain rate) from the other end of the plate-like portion 24 in the longitudinal direction to (towards) one end of the locking piece 22 forming the portion other than the thick-plate portion 23. In other words, the sloped portion 26 continuously connects the other end (base end) of the plate-like portion 24 in the longitudinal direction and one end of the locking piece 22 forming the portion other than the thick-plate portion 23, and the sloped portion 26 is a portion that is formed to have a plate thickness that decreases gradually (at a certain rate) in (towards) the rotation direction of the rotor disc 53 (see FIG. 5) (direction in which the rotor disc 53 rotates).

In addition, in the region from the one end (distal end) to the other end (base end) of the sloped portion 26 in the longitudinal direction, a cut-out portion 29 is provided. The cut-out portion 29 is formed of the inner circumferential surface facing (in contact with) the outer circumferential surface of the protruding portion 65 and the bottom surface that is located at the outer side in the axial direction so as to face (be in contact with) the wall surface forming the locking groove 67.

The inner circumferential surface of the cut-out portion 29 is formed to have a surface flush with the inner circumferential surface of the cut-out portion 27, and the bottom surface of the cut-out portion 29 is formed to have a surface flush with the bottom surface of the cut-out portion 27. In addition, the plate thickness of the cut-out portion 29 is the same as the plate thickness of the locking piece 66 and the plate thickness of the locking piece 22 forming the portion other than the thick-plate portion 23.

With the turbine-blade retaining structure 21 according to this embodiment, the end portion of the locking piece 22 exposed through the insertion window portion 68 is formed to have the plate thickness greater than that of the locking piece 22 forming the portion other than the thick-plate portion 23; in other words, the end portion of the locking piece 22 exposed through the insertion window portion 68 is formed such that the rigidity thereof is higher (greater) than that in a conventional structure.

By doing so, it is possible to prevent (reduce) deformation of the end portions of the locking pieces 22 and 66 exposed through the insertion window portion 68 in the axial direction and to prevent the occurrence of a crack in the welded portion 70.

In addition, with the turbine-blade retaining structure 21 according to this embodiment, a part of the welded portion 70 that joins the end portions of the adjacent locking pieces 22 and 66 exposed through the insertion window portion 68 to each other is located (accommodated) in the recessed groove 28.

By doing so, it is possible to reduce the problem where a crack tends to be caused in the welded portion 70 that has been eroded and weakened due to collision of the steam drain 72 on the welded portion 70.

Furthermore, with the turbine-blade retaining structure 21 according to this embodiment, the welded portion 70 that joins the end portions of the adjacent locking pieces 22 and 66 exposed through the insertion window portion 68 to each other is formed on the opposite side of the thick-plate portion 23 from the leading side in the rotation direction of the rotor disc 53. In other words, the welded portion 70 that joins the end portions of the adjacent locking pieces 22 and 66 exposed through the insertion window portion 68 to each other is provided behind the thick-plate portion 23.

By doing so, it is possible to further reduce the problem where a crack tends to be caused in the welded portion 70 that has been eroded and weakened due to collision of the steam drain 72 on the welded portion 70.

In addition, with the turbine-blade retaining structure 21 according to this embodiment, the sloped portion 25 is provided so as to be formed to have a plate thickness that increases gradually from one end of the locking piece 22, which is joined by means of welding, towards the side at the other end, and the last locking piece 66 to be inserted into the insertion window portion 68 is inserted along the sloped portion 25.

By doing so, it is possible to insert the last locking piece 66 to be inserted into the insertion window portion 68 with ease and to improve the ease of assembly.

On the other hand, with the steam turbine provided with the turbine-blade retaining structure 21 according to this embodiment, it is possible to prevent fragments of the locking pieces 22 and 66 and the welded portion 70 from scattering downstream, thereby improving the reliability of the steam turbine.

Note that the present invention is not limited to the above-mentioned embodiments, and appropriate modifications/alterations are possible as needed.

For example, in the above-mentioned embodiments, the turbine-blade retaining structure according to the present invention has been explained in terms of one that is utilized in steam turbines as a specific example; however, the present invention is not limited thereto, and it is also possible to utilize the turbine-blade retaining structure in rotary machines other than steam turbines (rotary machines such as gas turbines, compressors, and so forth, in which the turbine blades are fixed to a rotor disc).

In addition, in the above-mentioned embodiment, an explanation has been given by mentioning the structure in which the thick-plate portion 13 or 23 is provided on only the end portion of one locking piece 12 or 22 among the two adjacent locking pieces exposed through the insertion window portion 68, in other words, only the end portion of the locking piece 12 or 22 on the leading side in the rotation direction of the rotor disc 53, as a specific example; however, the present invention is not limited thereto, and the thick-plate portion 13 or 23 may be provided on only the end portion of the other locking piece 66 among the two adjacent locking pieces exposed through the insertion window portion 68. In other words, only the end portion of the locking piece 66 on the opposite side from the leading side in the rotation direction of the rotor disc 53, and the thick-plate portion 13 or 23 may be provided on the end portions of both of the locking pieces 12 or 22 and 66.

REFERENCE SIGNS LIST

11 turbine-blade retaining structure
12 locking piece
13 thick-plate portion
16 recessed groove
21 turbine-blade retaining structure
22 locking piece
23 thick-plate portion
25 sloped portion
28 recessed groove
52 turbine blade

53 rotor disc
61 blade groove
62 blade root
65 protruding portion
66 locking piece
67 locking groove
68 insertion window portion
69 step portion

The invention claimed is:

1. A turbine-blade retaining structure comprising:

blade grooves that extend through a rotor disc in a disc-thickness direction so as to receive blade roots of turbine blades arranged in a circumferential direction;

a protruding portion that protrudes, as a whole, outwards in the disc-thickness direction such that an outer circumferential end is located at an inner side of an inner circumferential end of the blade grooves in the radial direction;

a ring-shaped locking groove that is formed in a circumferential edge portion of the protruding portion along the circumferential direction so as to open towards an outer side in the radial direction;

a step portion that protrudes outwards in the disc-thickness direction in a circumferential edge portion on an inner circumferential side of the blade root so as to face the locking groove; and plate-like locking pieces arranged in the circumferential direction and received in the ring-shaped locking groove, the locking pieces being fitted between the locking groove and the step portion;

wherein the circumferential edge portion of the protruding portion is provided with, along the circumferential direction, at least one insertion window portion that is cut out in the disc-thickness direction such that an inner circumferential surface thereof is flush with an inner circumferential surface of the locking groove, and end portions of adjacent locking pieces, exposed through the insertion window portion, are joined to each other by means of welding; and at least one of the end portions of the adjacent locking pieces exposed through the insertion window portion is provided with a thick-plate portion expanding in the disc-thickness direction so as to be inside the insertion window portion.

2. A turbine-blade retaining structure according to claim 1, wherein the thick-plate portion is provided from one end of the locking piece that is joined by means of welding, towards a side at the other end.

3. A turbine-blade retaining structure according to claim 2, wherein a recessed groove is provided in a central portion of the thick-plate portion in the width direction so as to extend from the one end of the locking piece, which is joined by means of welding, towards the side at the other end and so as to open at the one end.

4. A turbine-blade retaining structure according to claim 1, wherein the thick-plate portion is provided on end portion of the locking piece on a leading side in a rotation direction of the rotor disc.

5. A turbine-blade retaining structure according to claim 1, wherein a sloped portion is provided so as to be formed to have a plate thickness that increases gradually from one end of the locking piece, which is joined by means of welding, towards a side at the other end.

6. A rotary machine comprising the turbine-blade retaining structure according to claim 1.

7. A turbine-blade retaining structure comprising:

blade grooves that extend through a rotor disc in a disc-thickness direction so as to receive blade roots of turbine blades arranged in a circumferential direction;

a protruding portion that protrudes, as a whole, outwards in the disc-thickness direction such that an outer circumferential end is located at an inner side of an inner circumferential end of the blade grooves in the radial direction;

a ring-shaped locking groove that is formed in a circumferential edge portion of the protruding portion along the circumferential direction so as to open towards an outer side in the radial direction;

a step portion that protrudes outwards in the disc-thickness direction in a circumferential edge portion on an inner circumferential side of the blade root so as to face the locking groove; and plate-like locking pieces received in the ring-shaped locking groove and fitted between the locking groove and the step portion;

wherein the circumferential edge portion of the protruding portion is provided with, along the circumferential direction, at least one insertion window portion that is cut out in the disc-thickness direction such that an inner circumferential surface thereof is flush with an inner circumferential surface of the locking groove, and end portions of adjacent locking pieces are exposed through the insertion window portion and are joined to each other by means of welding; and at least one of the end portions of the locking pieces is provided with a thick-plate portion expanding in the disc-thickness direction.

8. A turbine-blade retaining structure according to claim 7, wherein the thick-plate portion is provided from one end of the locking piece that is joined by means of welding, towards a side at the other end.

9. A turbine-blade retaining structure according to claim 8, wherein a recessed groove is provided in a central portion of the thick-plate portion in the width direction so as to extend from the one end of the locking piece, which is joined by means of welding, towards the side at the other end and so as to open at the one end.

10. A turbine-blade retaining structure according to claim 7, wherein the thick-plate portion is provided on end portion of the locking piece on a leading side in a rotation direction of the rotor disc.

11. A turbine-blade retaining structure according to claim 7, wherein a sloped portion is provided so as to be formed to have a plate thickness that increases gradually from one end of the locking piece, which is joined by means of welding, towards a side at the other end.

12. A rotary machine comprising the turbine-blade retaining structure according to claim 7.

* * * * *